US008297665B2

(12) United States Patent
Ramsauer

(10) Patent No.: US 8,297,665 B2
(45) Date of Patent: Oct. 30, 2012

(54) SNAP-ACTION CLOSURE SUITABLE FOR A THIN-WALLED CABINET

(76) Inventor: Dieter Ramsauer, Schwelm (DE)

( * ) Notice: Subject to any disclaimer, the term of this patent is extended or adjusted under 35 U.S.C. 154(b) by 49 days.

(21) Appl. No.: 11/921,255

(22) PCT Filed: Oct. 13, 2005

(86) PCT No.: PCT/EP2005/010985

§ 371 (c)(1),
(2), (4) Date: Nov. 29, 2007

(87) PCT Pub. No.: WO2007/006339

PCT Pub. Date: Jan. 18, 2007

(65) Prior Publication Data

US 2009/0134639 A1 May 28, 2009

(30) Foreign Application Priority Data

Jun. 3, 2005 (DE) ..... 20 2005 008 844 U

(51) Int. Cl.
*E05C 19/10* (2006.01)
*E05C 19/00* (2006.01)

(52) U.S. Cl. ..... 292/95; 292/121; 292/163; 292/226

(58) Field of Classification Search ..... 292/95, 292/121, 122, 124, 126, 128, 163, 226
See application file for complete search history.

(56) References Cited

U.S. PATENT DOCUMENTS 905,936 A * 12/1908 Schleicher et al. ..... 292/128
970,661 A * 9/1910 Stoddard ..... 292/128
1,063,157 A * 5/1913 Cottle ..... 292/128
1,098,703 A * 6/1914 Balfour ..... 292/124
1,241,192 A * 9/1917 Bruder ..... 292/83
1,426,239 A * 8/1922 Witzberger ..... 411/385
1,538,320 A * 5/1925 Gullong ..... 40/663

(Continued)

FOREIGN PATENT DOCUMENTS

DE 9411368 * 9/1994

(Continued)

OTHER PUBLICATIONS

Publication by DIRAK GmbH & Co. KG, Königsfelder Str. 1, D-58256 Ennepetal, Germany dating from Aug. 5, 1998 (Catalog p. 1-060).

*Primary Examiner* — Carlos Lugo
(74) *Attorney, Agent, or Firm* — Frommer Lawrence & Haug LLP

(57) ABSTRACT

A snap closure suitable for a thin-walled cabinet such as a sheet-metal cabinet, particularly for drawers, plug-ins, doors, or the like which can be pushed into or swiveled into a sheet-metal cabinet, comprises a housing which can be mounted in an opening of the cabinet sheet metal. One side (the outer side) of the housing has a handle and a closure actuating element, while a closure hook proceeds from its other side (inner side) so as to be swivelable against spring force. The closure hook is connected to the actuating element by a freewheeling coupling. According to the invention, the actuating element is formed by the handle which is mounted in the housing so as to be swivelable around an axis, and this axis is parallel to or coaxial to the axis of the closure hook.

16 Claims, 18 Drawing Sheets

U.S. PATENT DOCUMENTS

| | | | | | |
|---|---|---|---|---|---|
| 1,639,878 | A | * | 8/1927 | Bentrott | 292/128 |
| 1,929,775 | A | | 10/1933 | De Voe | |
| 2,010,492 | A | * | 8/1935 | Karre | 292/126 |
| 2,042,024 | A | * | 5/1936 | Schlage | 292/341.18 |
| 2,044,500 | A | * | 6/1936 | Geske et al. | 292/254 |
| 2,424,757 | A | * | 7/1947 | Klumpp, Jr. | 174/153 G |
| 2,647,780 | A | | 8/1953 | Knuth | |
| 3,583,736 | A | * | 6/1971 | Willimzik | 292/16 |
| 4,969,916 | A | | 11/1990 | Weinerman et al. | |
| 5,435,159 | A | * | 7/1995 | Ramsauer | 70/370 |
| 5,775,140 | A | | 7/1998 | Hallsten | |
| 6,547,289 | B1 | * | 4/2003 | Greenheck et al. | 292/126 |
| 6,550,824 | B1 | * | 4/2003 | Ramsauer | 292/126 |
| 7,690,083 | B2 | * | 4/2010 | Ramsauer | 16/382 |
| 2006/0087130 | A1 | * | 4/2006 | Liang | 292/242 |
| 2008/0127458 | A1 | * | 6/2008 | Ramsauer | 16/412 |
| 2009/0160199 | A1 | * | 6/2009 | Ramsauer | 292/256 |

FOREIGN PATENT DOCUMENTS

| | | | |
|---|---|---|---|
| FR | 2791080 | * | 3/1999 |
| WO | 01/31153 | | 5/2001 |
| WO | 01/79638 | | 10/2001 |

* cited by examiner

Fig. 7A
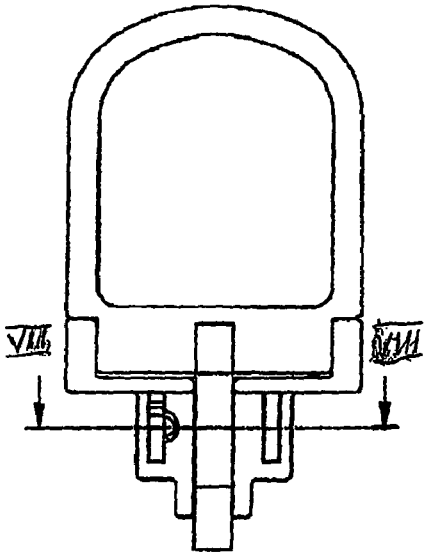
Fig. 7B
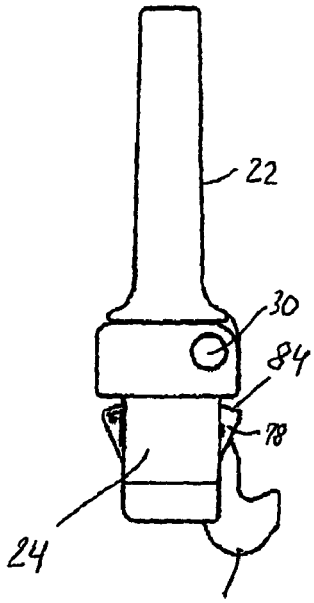
Fig. 9.
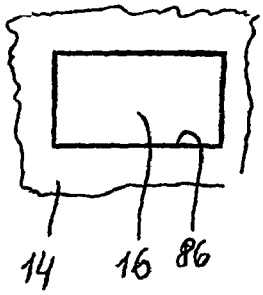
Fig 7C
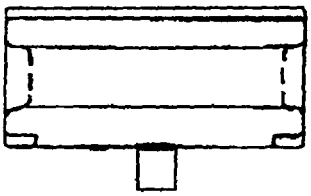
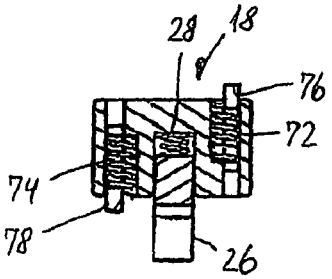
Fig. 8.
Fig. 6.
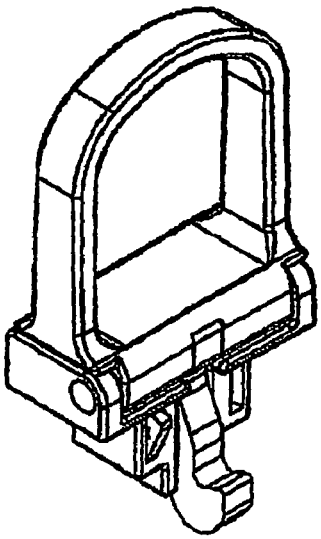

SNAP-ACTION CLOSURE SUITABLE FOR A THIN-WALLED CABINET

CROSS-REFERENCE TO RELATED APPLICATIONS

This is a national phase application of International Application No. PCT/EP2005/010985, filed Oct. 13, 2005 which claims priority of German Application No. 20 2005 008 844.7, filed June 3, 2005, the complete disclosures of which are hereby incorporated by reference.

BACKGROUND OF THE INVENTION a) Field of the Invention

The invention is directed to a snap closure suitable for a thin-walled cabinet such as a sheet-metal cabinet, particularly for drawers, plug-ins, doors, or the like which can be pushed into or swiveled into a sheet-metal cabinet, comprising a housing which can be mounted in an opening of the cabinet sheet metal, one side (the outer side) of the housing having a handle and a closure actuating means, while a closure hook proceeds from its other side (inner side) so as to be swivelable against spring force and is connected to the actuating means by a freewheeling coupling.

b) Description of the Related Art

A snap closure of the type mentioned above is known from catalog page 1-060 of a publication by DIRAK GmbH & Co. KG, Königsfelder Str. 1, D-58256 Ennepetal, dating from Aug. 5, 1998.

The prior art has the disadvantage that the handle and actuating means are two separate structural component parts which must be operated together by the thumb and index finger.

OBJECT AND SUMMARY OF THE INVENTION

It is the primary object of the invention to overcome the disadvantage mentioned above and to provide a snap closure which is simple to operate with any finger.

This (partial) object is met in that the actuating means is formed by the handle which is mounted in the housing so as to be swivelable around an axis, and in that this axis is parallel to or coaxial to the axis of the closure hook.

Another (partial) object consists in simplifying the mounting of the snap closure in the opening of the thin wall, particularly in such a way that blind mounting is possible, that is, only the front fastening surface need be accessible for mounting.

This partial object is met in that the housing is secured in the cabinet sheet metal by means of a snap fastening.

The second partial object is related to the first partial object in that they each require a large cutout in the thin wall in relation to the wall thickness and that both associated solutions work with snap devices which engage behind an edge of the cutout. The two openings can be produced during the same punching process.

According to a further development, the snap fastening is designed in such a way that it has two slides running in opposite directions which are mounted in the housing so as to be displaceable parallel to the fastening plane against spring force and form a holding surface which is at an angle to the fastening plane and is supported on the inner edge of the opening in the cabinet sheet metal. These steps also compensate for inaccuracies in the machining of the sheet metal.

According to yet another construction of the invention, the handle is a U-shaped grip which guarantees an especially high stability. As in the prior art, the arrangement according to the invention can also be constructed symmetrically around a center plane and can therefore be employed when fastening to a left-hand side of the plug-in or the like and also to a right-hand side of a plug-in or the like.

When the axis of the handle is offset inside the housing in a direction in which the handle is swivelable, this offers the advantage that swiveling takes place in the opening direction simply by pulling so that operation is simplified even further.

The invention makes possible an embodiment form in which the handle and the closure hook are compelled into their respective rest position under the force of an individual spring.

Alternatively, if desired, the handle and the closure hook can also be compelled into their respective rest position under the force of their own spring.

It is advantageous when the handle has stop surfaces which abut at corresponding stop surfaces of the housing and accordingly limit the swiveling path of the handle between a locked rest position and an unlocked working position.

It is especially advantageous when the working position of the handle is so arranged that the point of attack or the pulling force of the hand on the handle when pulling the drawer or plug-in or the like out of the sheet-metal cabinet is oriented substantially to the swiveling axis so that the handle and the housing receive only a tensile load and not a bending load.

BRIEF DESCRIPTION OF THE DRAWINGS

The invention will be shown more fully in the following with reference to embodiment examples shown in the drawings.

FIG. 6 shows a perspective view of the assembled snap closure;

FIGS. 7A, 7B and 7C show different views of the snap closure from FIG. 6;

FIG. 8 shows a sectional view along section line VIII-VIII of FIG. 7A;

FIG. 9 shows a view of the associated opening in which the snap closure according to the invention can be mounted;

DESCRIPTION OF THE PREFERRED EMBODIMENTS

Figure 1:
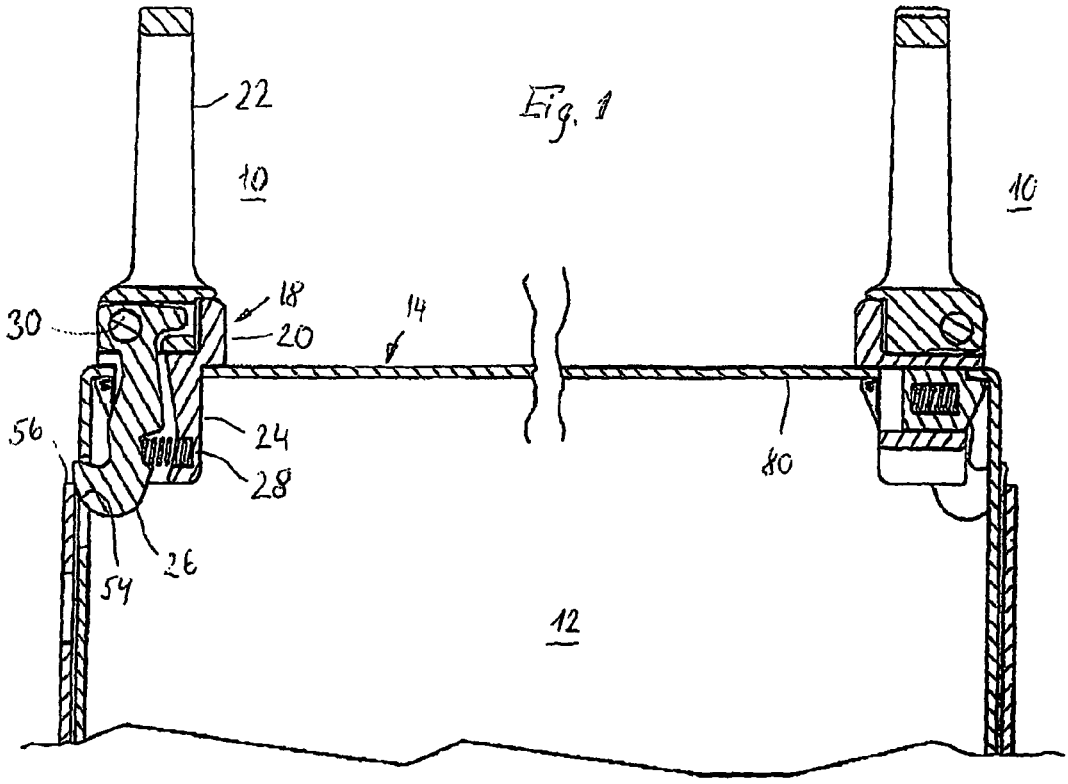
FIG. 1 shows two sectional views of a sheet-metal drawer which can be slid into a cabinet, with snap closure devices according to the invention.

FIG. 1 shows a snap closure 10 suitable for a thin-walled cabinet such as, as in the present instance, a sheet-metal cabinet 12, in this case for a drawer 14 which can be inserted into the sheet-metal cabinet 12. The snap closure 10, shown twice in FIG. 1, comprises a housing 18 which can be mounted in an opening 16 (see also FIG. 9) of the cabinet sheet metal 14. One side of the housing 18, the outer side 20, has a handle 22 which serves at the same time as closure actuating means (see FIG. 3). A closure hook 26 which is mounted in the housing 18 so as to be swivelable around a pin 30 against spring force 28 extends at the other side, namely, the inner side 24. The closure hook 26 is connected to the actuating means 22 by a coupling 32 with a free wheel 34. A particularly simple operation and also a particularly simple design are brought about according to the invention in that the actuating means are formed by the handle 22 which is mounted so as to be swivelable around an axis 30 in the housing 18 and in that this axis 30 is coaxial to and thus identical to the axis of the closure hook 26. The axis is formed by a pin 30 which is arranged inside the housing 18 so as to be offset in a direction 36 (see FIG. 3) in which the handle 22 is swivelable.

Figure 2:
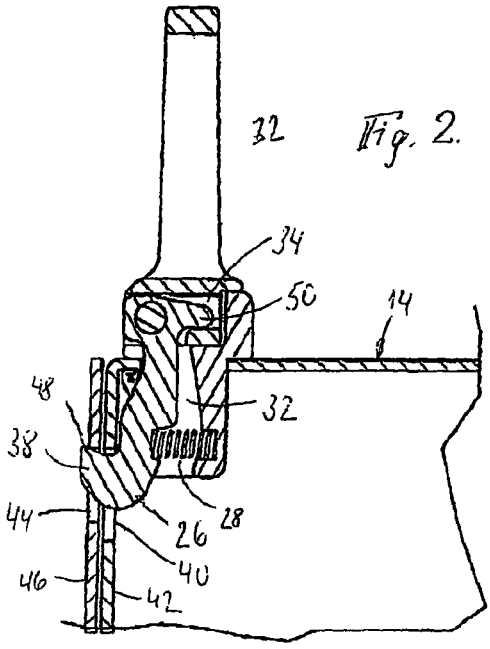
FIG. 2 shows the closure from FIG. 1, but in a locked position.

According to FIG. 2, the closure hook 26 is compelled into the rest position shown in FIG. 2 by a spring 28. In this rest position, the end of the hook 38 penetrates a slot-like opening 40 in the side wall 42 of the drawer 14 as well as a corresponding slot-like opening 44 in the side wall 46 of the cabinet housing 14. The hook 38 lies against the edge 48 of the slot in the housing and therefore prevents the drawer from being pulled out. Accordingly, this rest position is the locked position of the closure. The handle 22 is pushed into its unswiveled position, that is, into its rest position, by means of a lever projection 50 which is connected to the closure hook 26 so as to be rigid against rotation relative to it. This indicates to the user that the closure hook 26 is in the locked position and, at the same time, a spring is advantageously dispensed with because the spring 28 compels the closure hook 26 and the handle 22 into their respective rest positions in this way.

Of course, alternatively, the handle 22 may also be provided with its own spring, not shown, to compel it into its rest position according to FIG. 2.

The lever projection 50 extends into a slot 52 which is formed by the handle 22, and a certain play 34 remains between the lever 50 and the corresponding stop surfaces of the slot 52 resulting in the freewheeling of the coupling part formed in this way between the lever 22 and the projection 50. Accordingly, the closure hook 26 acquires a latch-like action, i.e., the drawer 14 can be pushed closed and, without actuating the handle 22, the closure hook 26 shown on the left-hand side referring to FIG. 1 can deflect accompanied by the compression of the spring 28 and by making use of the play 34, wherein the inclined surface 54 of the closure hook 26 interacts with the end edge 56 of the cabinet housing 12.

Figure 3:
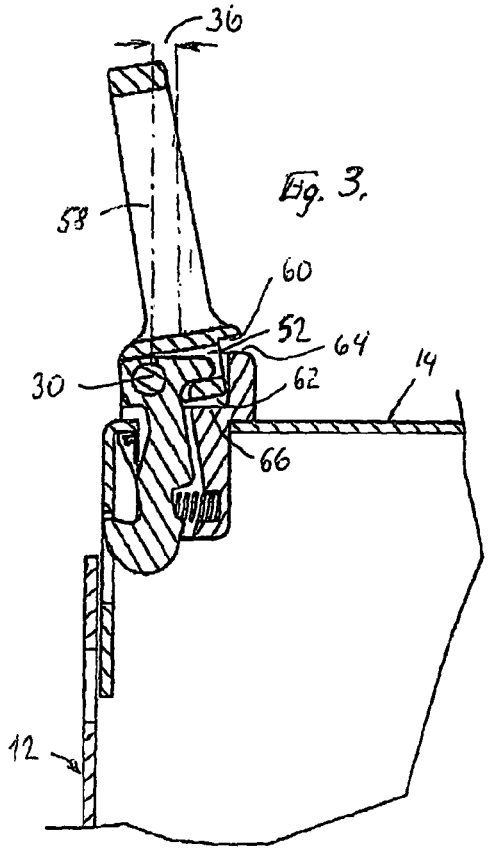
FIG. 3 shows the closure from FIG. 1, but in an unlocked position with the drawer partially pulled out.

To open the closure position shown in FIG. 2, the handle 22 is swiveled according to FIG. 3, and the coupling area 62 of the handle carries along the projection 50 of the closure hook 26 until its tip 38 exits from the slot 44 of the cabinet frame 12 as can be seen from FIG. 3.

Accordingly, the position of the handle 22 shown in FIG. 3 is its working position. The point of attack or the pulling force of the hand at the handle 22 is advisably oriented substantially to the swiveling pin 30 (see line 58) when pulling the drawer 14 or the plug-in 14 or the like out of the sheet-metal cabinet 12. In this position, the handle and the housing are accordingly only loaded by tensile force and not by bending. Further, the swiveling results automatically when pulling the handle, which simplifies operation.

The handle 22 has stop surfaces 60, 62 which abut at corresponding stop surfaces 64, 66 of the housing 18 and accordingly limit the swiveling path of the handle between a locking rest position according to FIG. 2 and an unlocking working position according to FIG. 3. The latter can also be omitted.

The housing of the snap closure could be fastened, as in the prior art, by means of head screws or also by means of a union nut or a fastening spring. However, a snap fastening which secures the housing in the cabinet sheet metal opening is more advantageous. This snap fastening preferably comprises at least two slides 76, 78 which run in opposite directions, are mounted in the housing 18 (reference numbers 68 and 70) so as to be displaceable parallel to the fastening plane 80 against spring force 72, 74 and form a holding surface 84 which is at an angle 82 to the fastening plane 80 and is supported on the inner edge 86 of the opening in the cabinet sheet metal 14.

As can be seen from the drawings, the handle is formed as a U-shaped grip.

FIG. 6 shows that the closure is constructed so as to be symmetrical around a center plane and, therefore, can be used when fastening to a left-hand side of a plug-in 14 or the like and, as can be seen in FIG. 1, to a right-hand side of a plug-in 14 or the like.

Alternatively, the closure can also be used at the top front edge of the plug-in, preferably in the center (not shown).

The coaxial arrangement of the axes of the closure hook 26 and handle 22 is particularly advantageous because both structural component parts 22, 26 can then be supported by one shaft such as a shaft pin 30. All of the embodiment forms shown herein have this feature (see reference numbers 30, 130, 230, 330).

By dispensing with the function of a free wheel between the closure hook and handle, a freewheeling coupling can be dispensed with and the snap closure can be simplified. In particular, the closure hook and handle can then be fashioned in one piece (not shown).

However, the advantage of forming the closure hook 26, 126, 226, 326 and handle 22, 122, 222, 322 in two or more pieces must not be overlooked. When formed of two pieces, the snap closure can be constructed in a modular manner, i.e., the handle can be designed differently. This also makes it possible to use different materials, e.g., steel or another, sturdier material for the closure hook, and aluminum or pressure-cast material or another, less robust material for the handle.

While the snap closure 10 according to FIGS. 1 to 9 has a handle 22 which is swivelable around an axis 30 parallel to its extension and can be mounted at the end of a beveled thin wall 14, the hook 26 being effective in this beveled area 42, FIGS. 10 to 21 show an embodiment form of a snap closure 110 in which the swiveling axis 130 of the handle 122 (and of the closure hook 126) extends perpendicular to the extension of the handle 122. It can be mounted remote of a bevel because the closure hook is mounted in the housing 118 so as to be swivelable at a greater distance from the thin wall 114 and can act at the thin wall 114 in the area of the fastening surface of the closure; that is, one thin wall 114 can be fastened to another thin wall 112, e.g., according to FIG. 10, the front side 114 of a plug-in which can be inserted into a cabinet 112. In this case, the housing 118 of the snap closure devices according to an alternative embodiment form has a head screw fastening which is shown in two sectional views.

Figure 10:
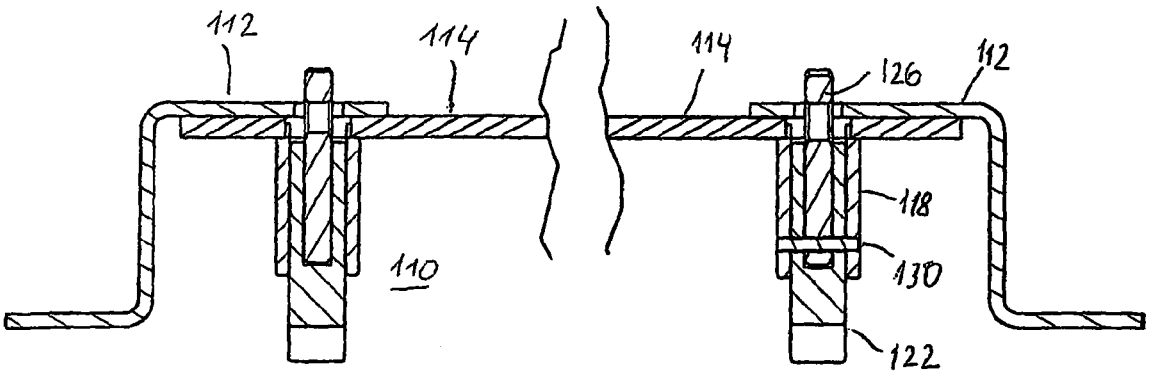
FIG. 10 shows the front side of a plug-in which can be inserted into a cabinet, with snap closure devices according to an alternative embodiment form with head screw fastening shown in two sectional views.
Figure 11:
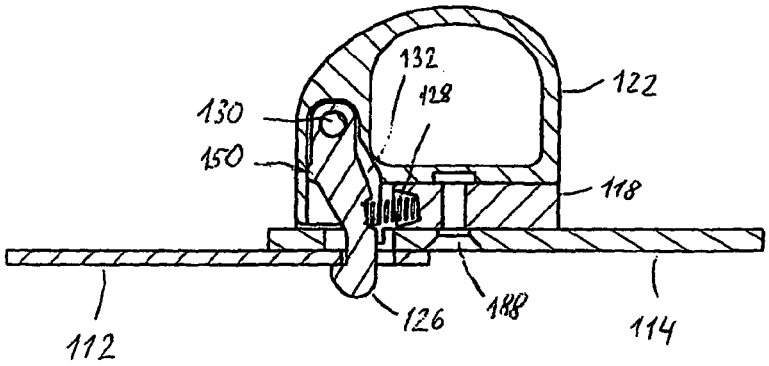
FIG. 11 shows the closure from FIG. 10 in longitudinal section in a locked position.
Figure 12B:
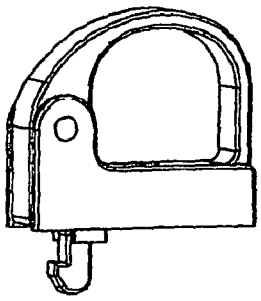
FIGS. 12A and 12B again show the closure from FIG. 10 in the locked position in longitudinal section and perspective, respectively.
Figure 12A:
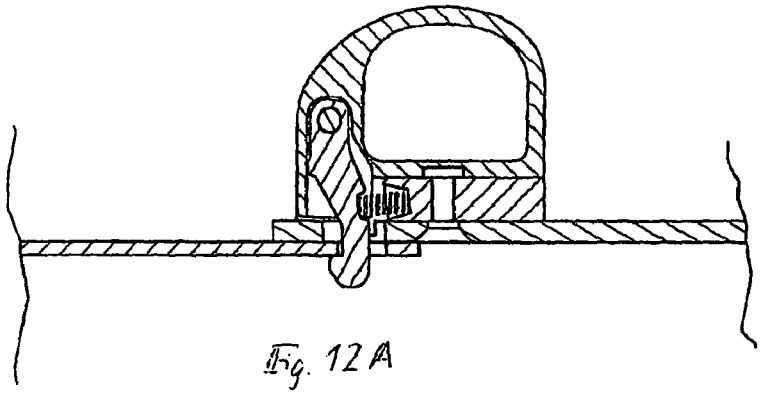
Figure 13B:
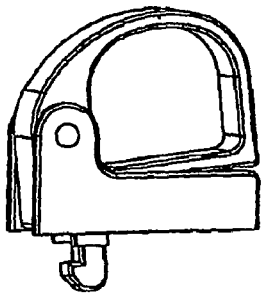
FIGS. 13A and 13B show the closure from FIG. 10 in the pulled in and unlocked position in views similar to those in FIGS. 12A and 12B.
Figure 13A:
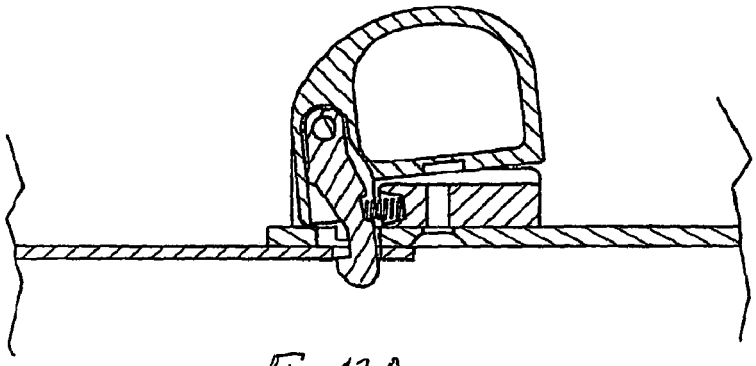
Figure 14B:
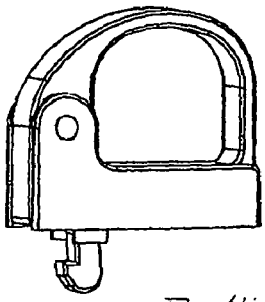
FIGS. 14A and 14B show the closure from FIG. 10 in the released, unlocked and open position in views similar to those in FIGS. 12A and 12B.
Figure 14A:
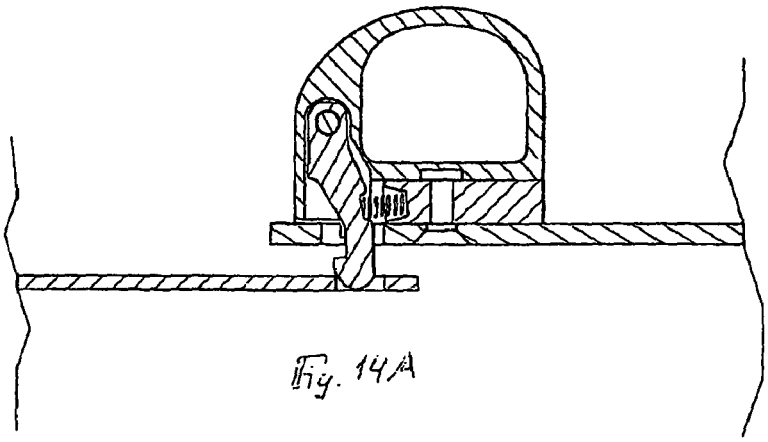

FIG. 11 shows the closure 110 from FIG. 10 in longitudinal section in the locked position. FIGS. 12A and 12B again show the closure from FIG. 10 in a locked position in longitudinal section and in a perspective view, respectively. FIGS. 13A and 13B show the closure 110 from FIG. 10 in the pulled in and unlocked position in views similar to those in FIGS. 12A and 12B. FIGS. 14A and 14B show the closure 110 from FIG. 10 in the released, unlocked and open position in views similar to those in FIGS. 12A and 12B. A freewheeling device comprising a lever projection 150, movement play 132 of the hook lever 126 in the housing 118, and a spring is also provided in this case.

Figure 15:
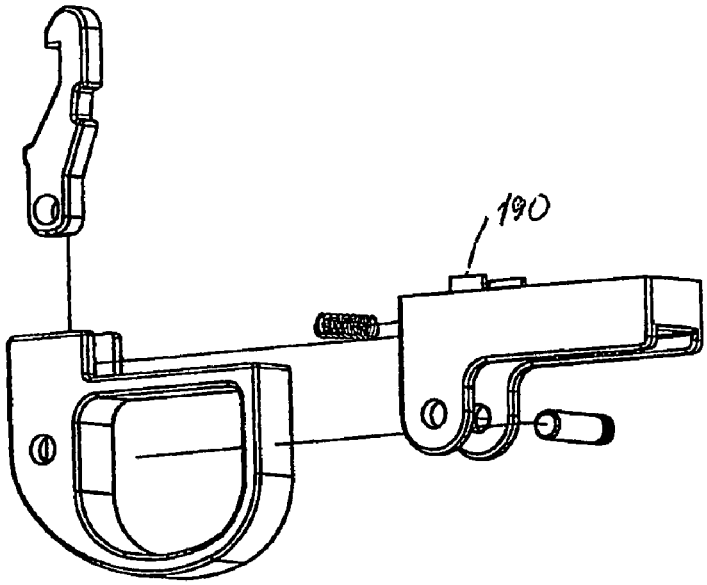
FIGS. 15 and 16 show the closure from FIG. 10 in two perspective, exploded views.
Figure 16:
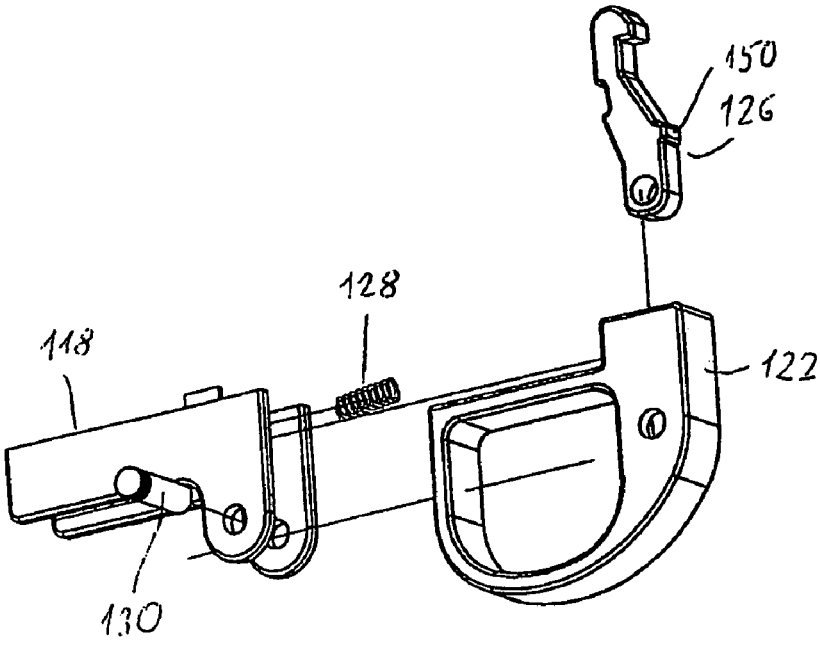
Figure 18A:
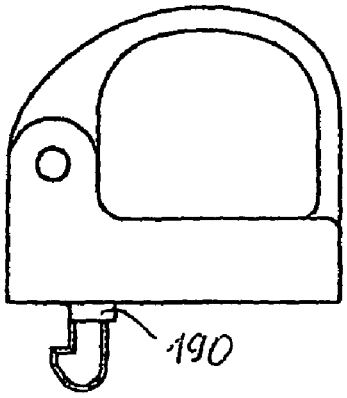
FIGS. 18A, B and C show a side view, a front view and a top view of the closure from FIG. 10.
Figure 18B:
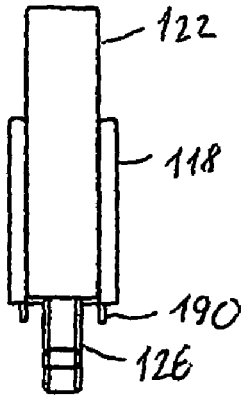
Figure 18C:
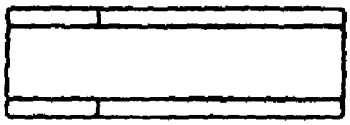
Figure 17:
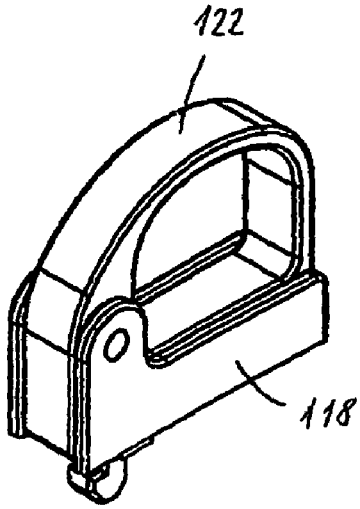
FIG. 17 shows a perspective view of the assembled closure from FIG. 10.

FIGS. 15 and 16 show the closure 110 from FIG. 10 in two perspective exploded views. FIG. 17 shows a perspective view of the assembled closure 110 from FIG. 10. FIGS. 18A, B and C show a side view, a front view and a top view of the closure 110 from FIG. 10.

Figure 19:
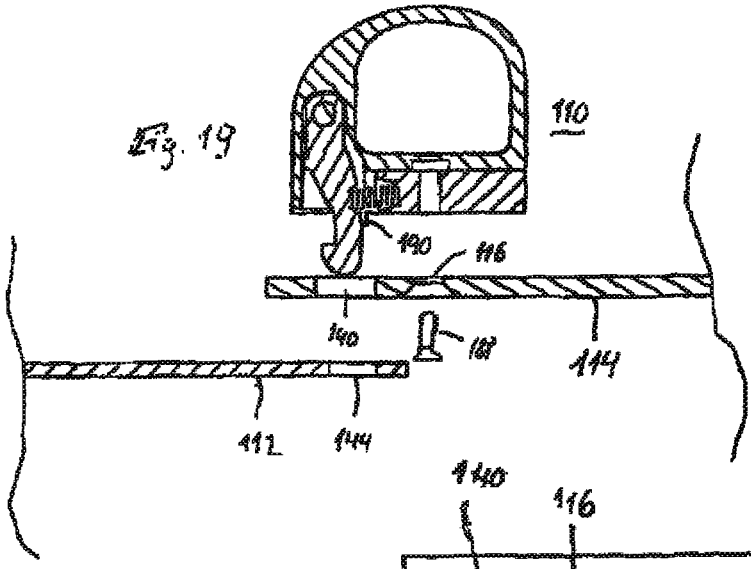
FIG. 19 shows the closure from FIG. 10 in the released, detached position in a view similar to that in FIG. 14A.
Figure 20:
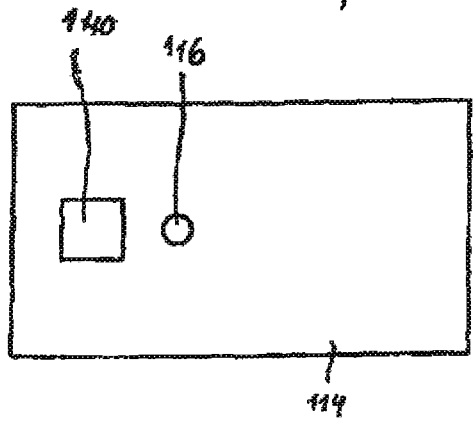
FIG. 20 shows the hole pattern in the plug-in and cabinet, which hole pattern is suitable for the closure from FIG. 10.
Figure 20:
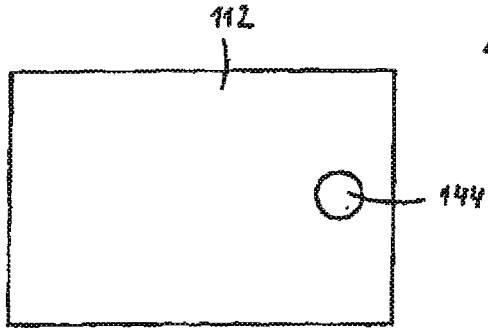

FIG. 19 shows the closure 110 from FIG. 10 in the released, detached position in a view similar to that in FIG. 14A. FIG. 20 shows the hole pattern in the plug-in 114 and cabinet 112, which hole pattern, namely round hole 116 for the fastening screw 188, rectangular hole 140 and opening 144 for the hook 126, is suitable for the closure from FIG. 10.

Figure 21:
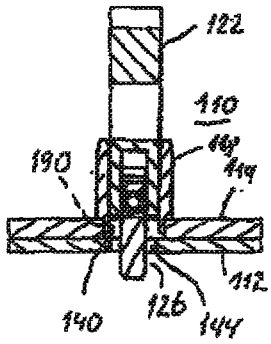
FIG. 21 shows a cross-sectional view through the closure from FIG. 10.

FIG. 21 shows a cross-sectional view through the closure 110 from FIG. 10 in the locking position.

In order to secure it with respect to rotation, projections 190 can project from the housing 11 into the rectangular hole 140, and the housing together with the fastening screw 188 can be oriented to the thin wall 114.

Figure 22:
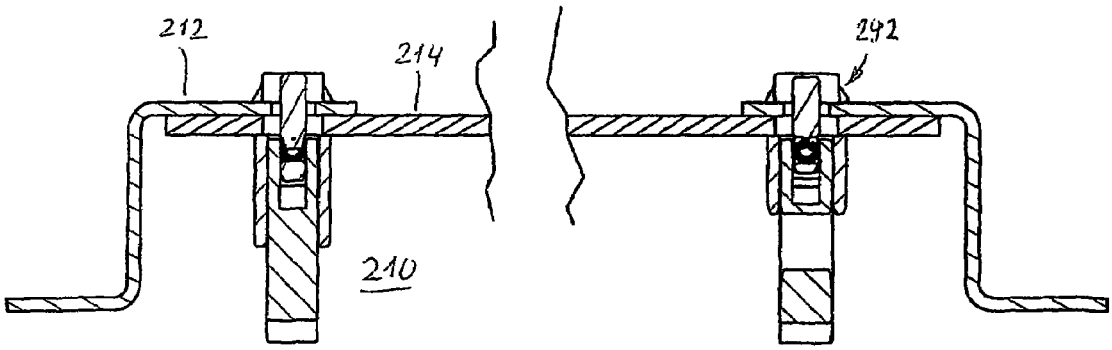
FIG. 22 shows in two sectional views the front side of a plug-in which can be inserted into a cabinet, with snap closure devices according to an alternative embodiment form, with snap fastening.

FIG. 22 shows two sectional views of the front side 214 of a plug-in which can be inserted into a cabinet 212, with snap closure devices according to an alternative embodiment form, which is outfitted with a snap fastening 192 instead of a screw fastening.

Figure 23:
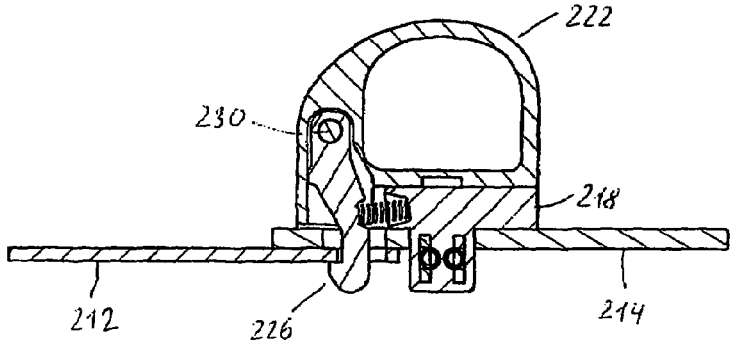
FIG. 23 shows the closure from FIG. 22 in longitudinal section in the locked position.
Figure 24:
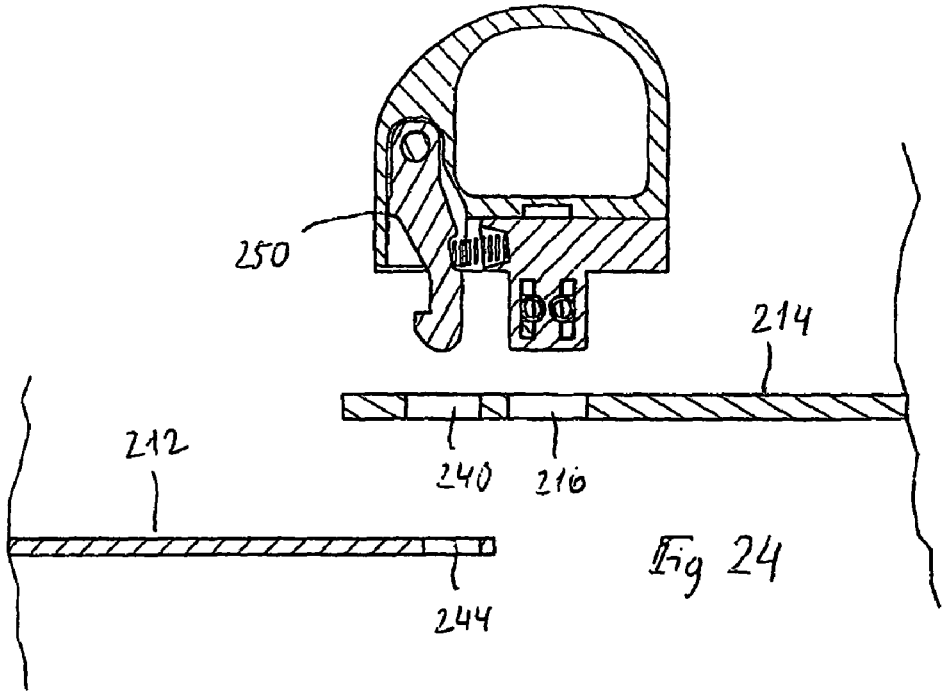
FIG. 24 shows the closure from FIG. 22 in the released, detached position in a view similar to that in FIG. 23.
Figure 25:
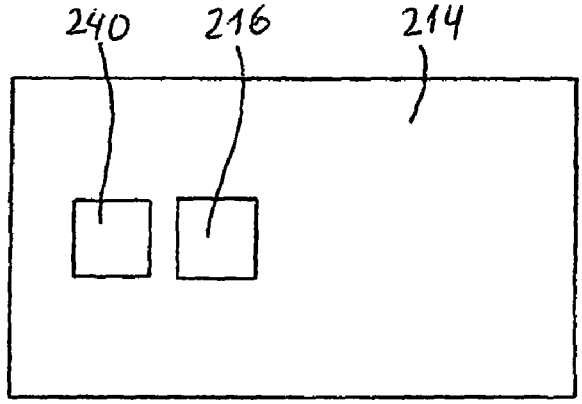
FIG. 25 shows the hole pattern in the plug-in and cabinet, which hole pattern is suitable for the closure from FIG. 22.
Figure 25:
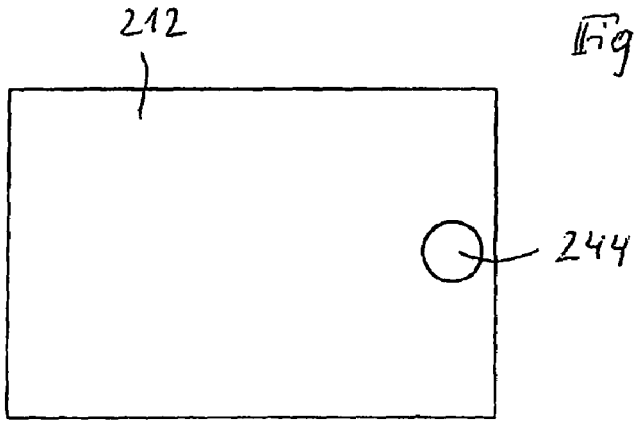

FIG. 23 shows the closure 210 from FIG. 22 in longitudinal section in the locked position. FIG. 24 shows the closure 210 from FIG. 22 in the released, detached position in a view similar to that in FIG. 23. FIG. 25 shows the hole pattern 216, 240 and 244 in the plug-in 214 and cabinet 212 which is suitable for the closure 210 from FIG. 22.

Figure 26B:
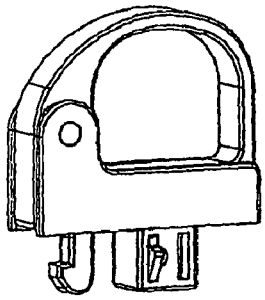
FIGS. 26A and 26B again show the closure from FIG. 22 in the locked position in longitudinal section and in a perspective view, respectively.
Figure 26A:
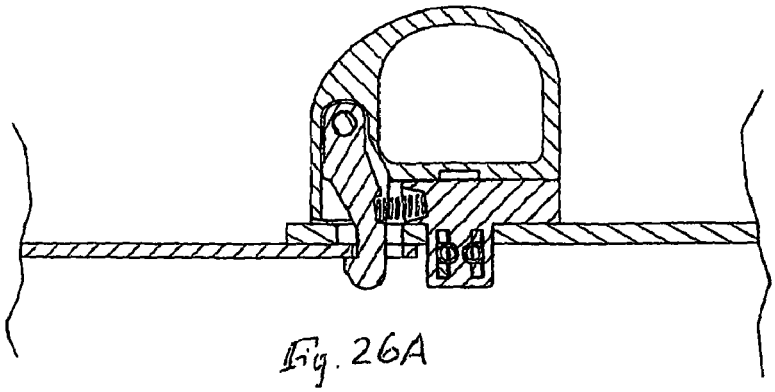
Figure 27B:
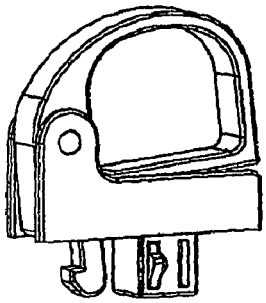
FIGS. 27A and 27B show the closure from FIG. 22 in the pulled in and unlocked position in views similar to those in FIGS. 26A and B.
Figure 27A:
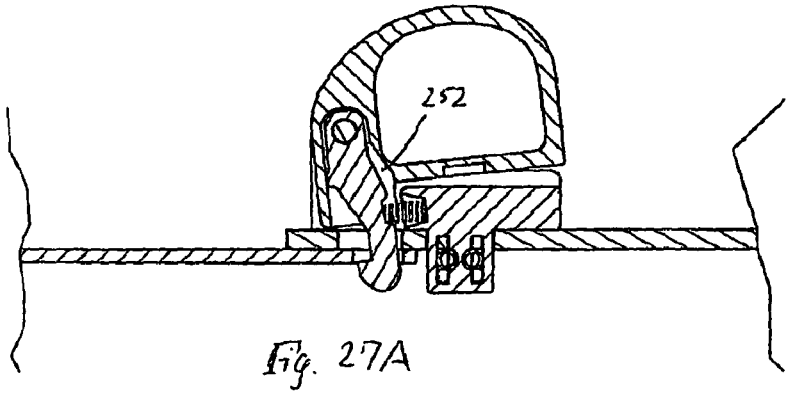
Figure 28B:
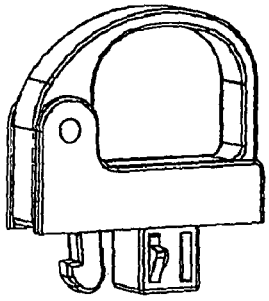
FIGS. 28A and 28B show the closure from FIG. 22 in the released, unlocked and open position in views similar to those in FIGS. 26A and B.
Figure 28A:
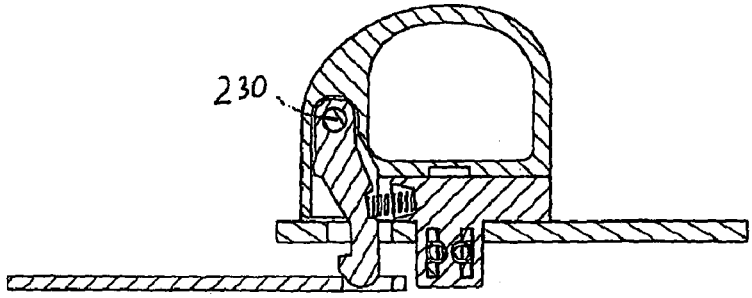

FIGS. 26A and 26B again show the closure 210 from FIG. 22 in the locked position in longitudinal section and in a perspective view, respectively. FIGS. 27A and 27B show the closure 210 from FIG. 22 in the pulled in and unlocked position in views similar to those in FIGS. 26A and 26B. FIGS. 28A and 28B show the closure 210 from FIG. 22 in the released, unlocked and open position in views similar to those in FIGS. 26A and 26B.

Figure 4:
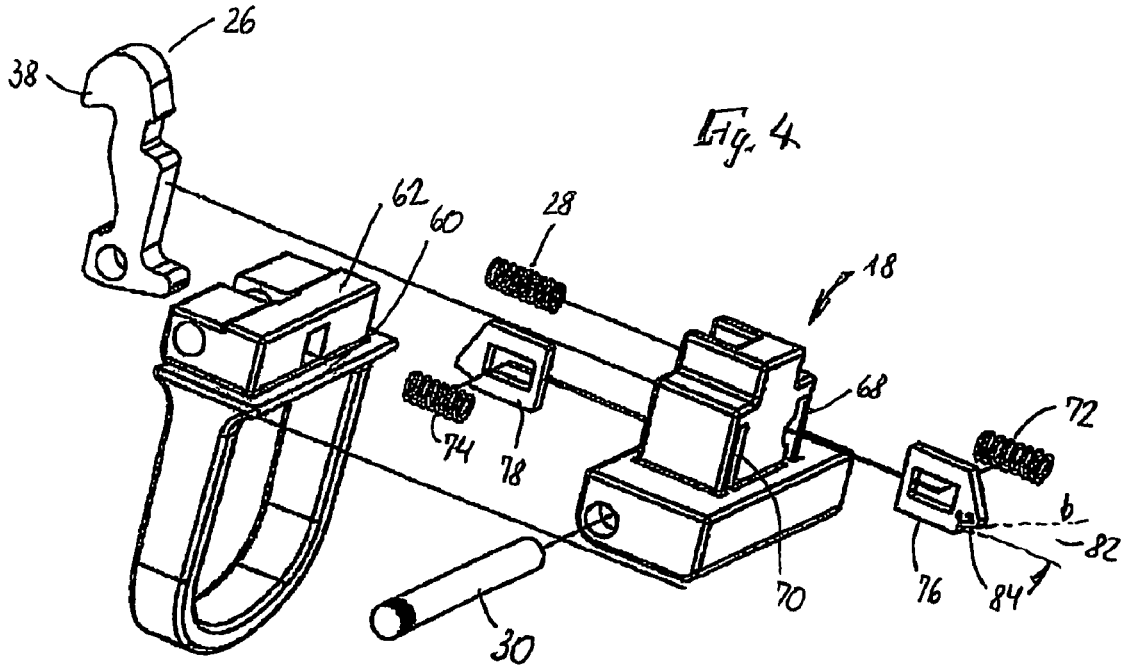
FIG. 4 and FIG. 5 show the snap closure from FIG. 1 in exploded, perspective views.
Figure 5:
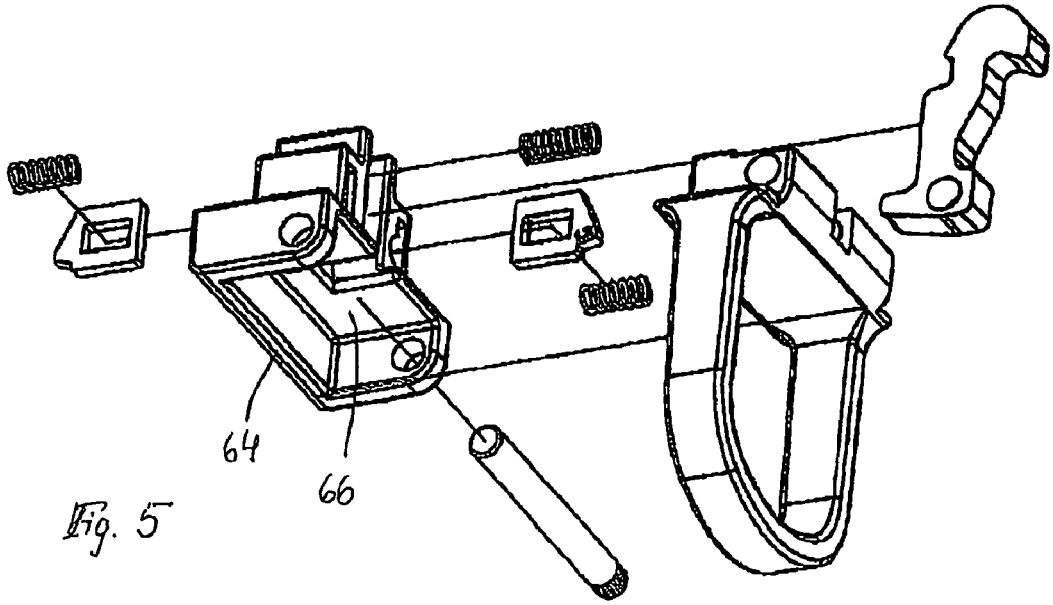
Figure 29:
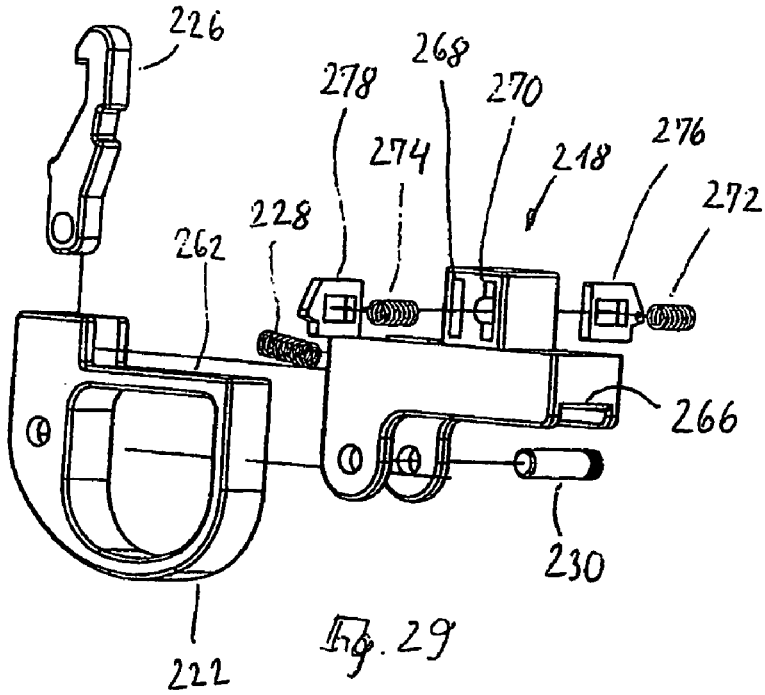
FIGS. 29 and 30 show the closure from FIG. 22 in two perspective, exploded views.
Figure 30:
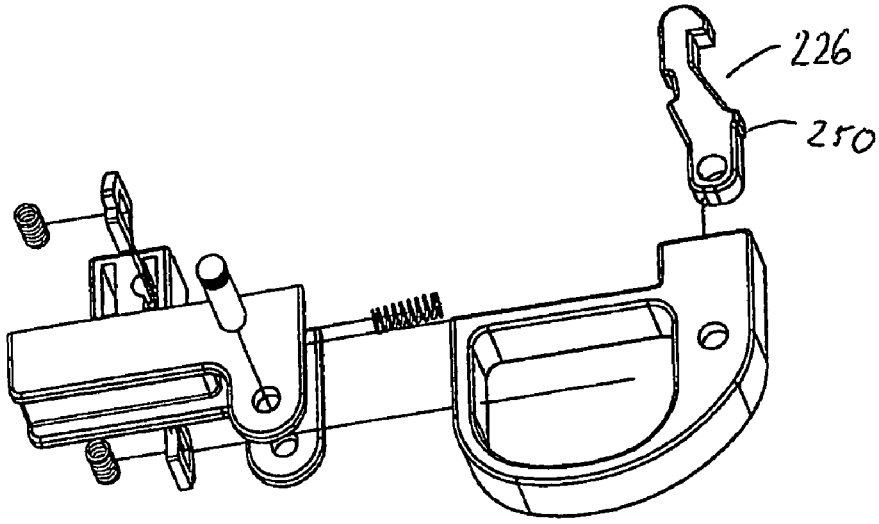

FIGS. 29 and 30 show two perspective, exploded views of the closure 210 from FIG. 22 which shows the snap fastening similar to that shown in FIG. 4, wherein similar parts are designated by reference numbers increased by 200.

Figure 32A:
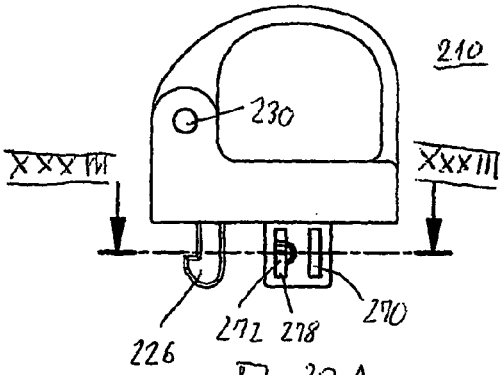
FIGS. 32A, B and C show a side view, front view and top view of the closure from FIG. 22.
Figure 32B:
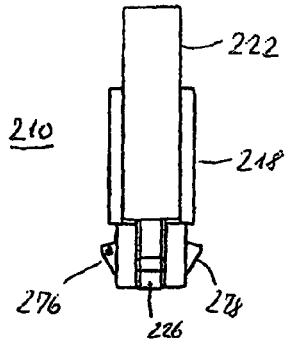
Figure 32C:
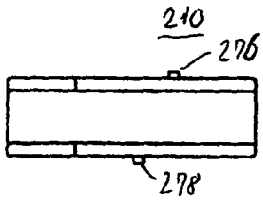
Figure 31:
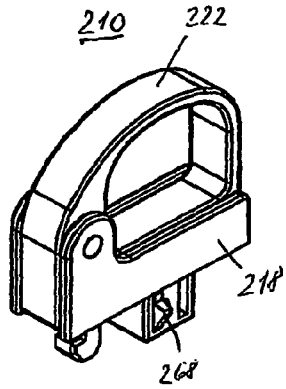
FIG. 31 shows a perspective view of the assembled closure from FIG. 22.

FIG. 31 shows a perspective view of the assembled closure 210 from FIG. 22. FIGS. 32A, B and C show a side view, front view and top view of the closure 210 from FIG. 22.

Figure 33:
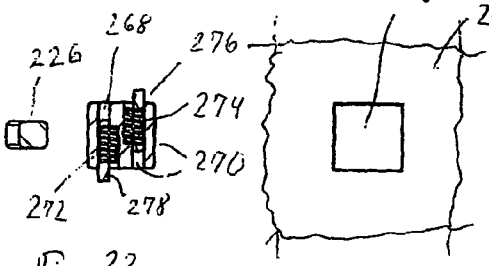
FIG. 33 shows a sectional view along line XXXIII-XXXIII of FIG. 32A to illustrate the snap fastening of the closure from FIG. 22.
Figure 34:
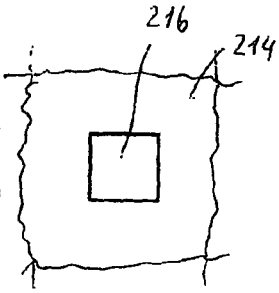
FIG. 34 shows the associated hole pattern for the snap fastening.

FIG. 33 shows a sectional view along line XXXIII-XXXIII of FIG. 32A to illustrate the snap fastening 292 of the closure 210 from FIG. 22. FIG. 34 shows the associated hole pattern 216 in the thin wall 214 for the snap fastening 292.

Figure 35:
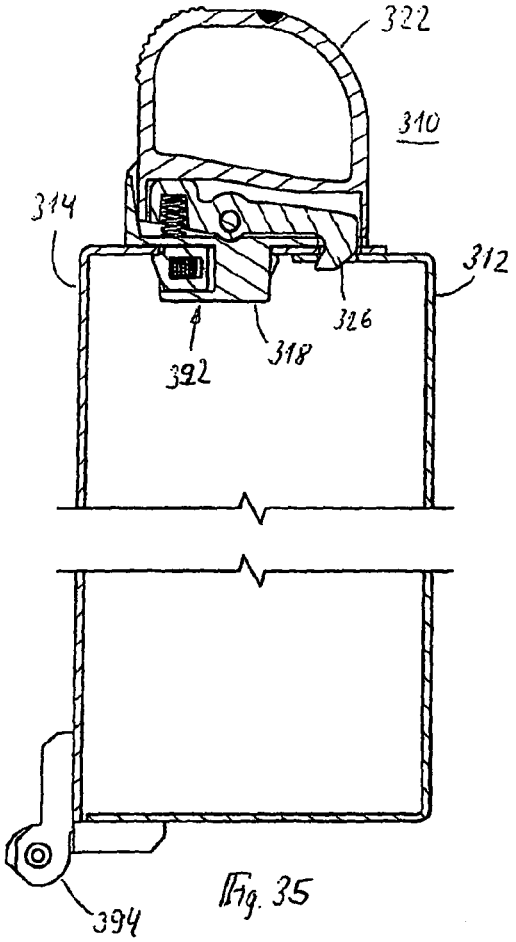
FIG. 35 is a cross-sectional view in the released, locked position showing the front side of a cover closing a box, with snap closure devices according to an alternative embodiment form, with snap fastening.
Figure 36:
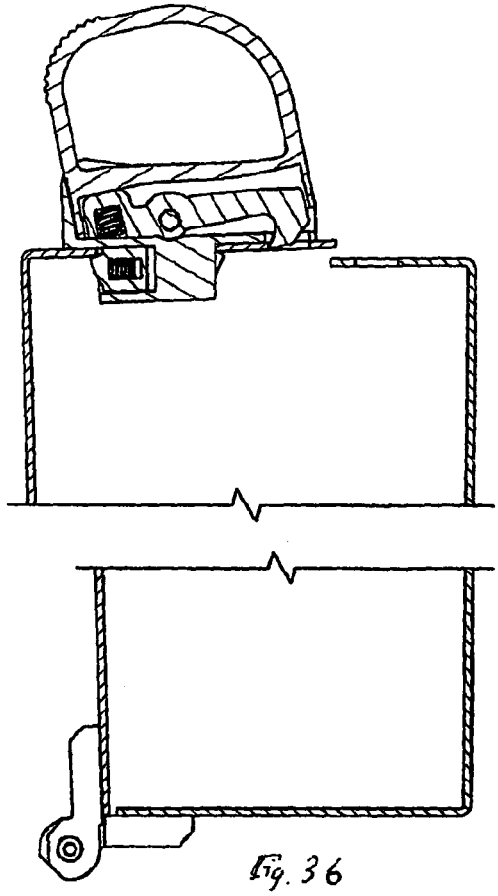
FIG. 36 shows the closure from FIG. 35 in longitudinal section in the pulled in, unlocked position and with the cover slightly raised.
Figure 37:
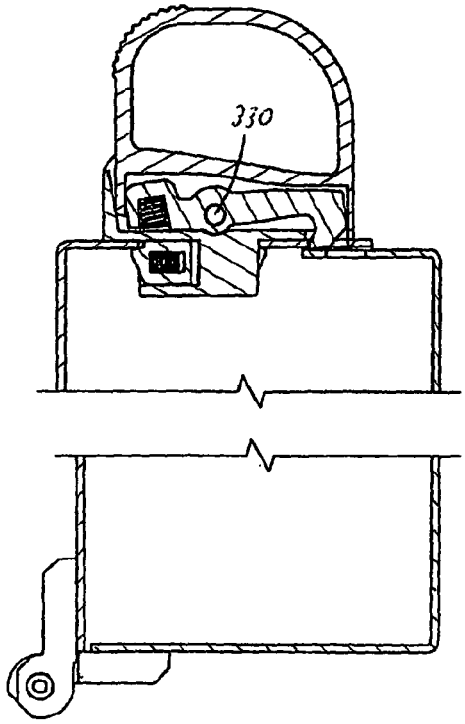
FIG. 37 shows the closure from FIG. 36 in the released, unlocked position prior to the snap-type closing in a view similar to that in FIG. 35.
Figure 38:
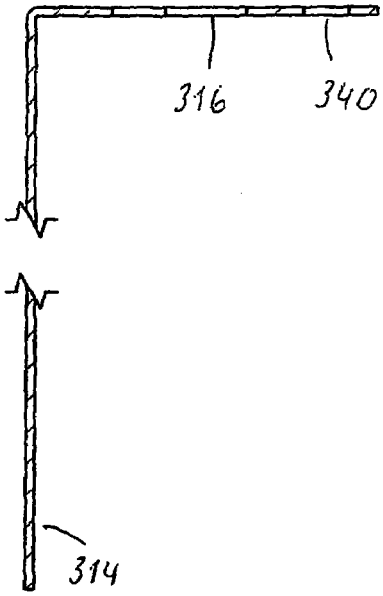
FIGS. 38, 39 and 40 show a sectional view and a top view of the cover and box with the hole pattern suitable for the closure from FIG. 35.
Figure 39:
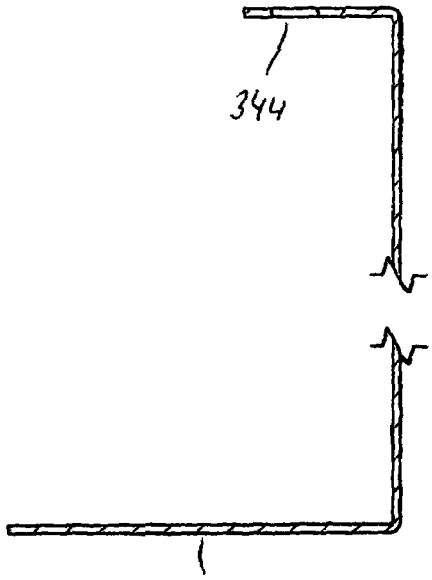
Figure 40:
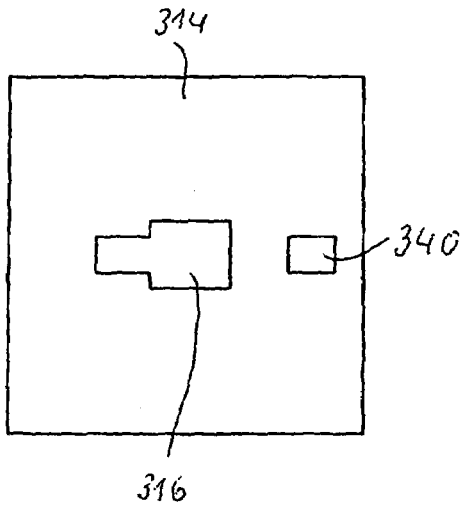
Figure 40:
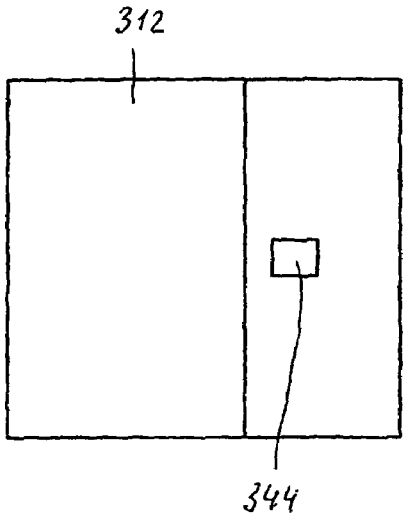

FIG. 35 is a cross-sectional view of the front side of a cover 314 closing a box 312, with hinge 394 and snap closure devices 310 according to an alternative embodiment form provided with snap fastening 392, shown in the released, locked position. FIG. 36 shows the closure from FIG. 35 in longitudinal section in the pulled in, unlocked position and with the cover 314 slightly raised. FIG. 37 shows the closure 310 from FIG. 35 in the released, unlocked position prior to the snap-type closing in a view similar to that in FIG. 35. FIGS. 38, 39 and 40 show a sectional view and a top view of the cover 314 and box 312 with the hole pattern 316 and 340, 344 suitable for the closure 310 from FIG. 35.

Figure 41:
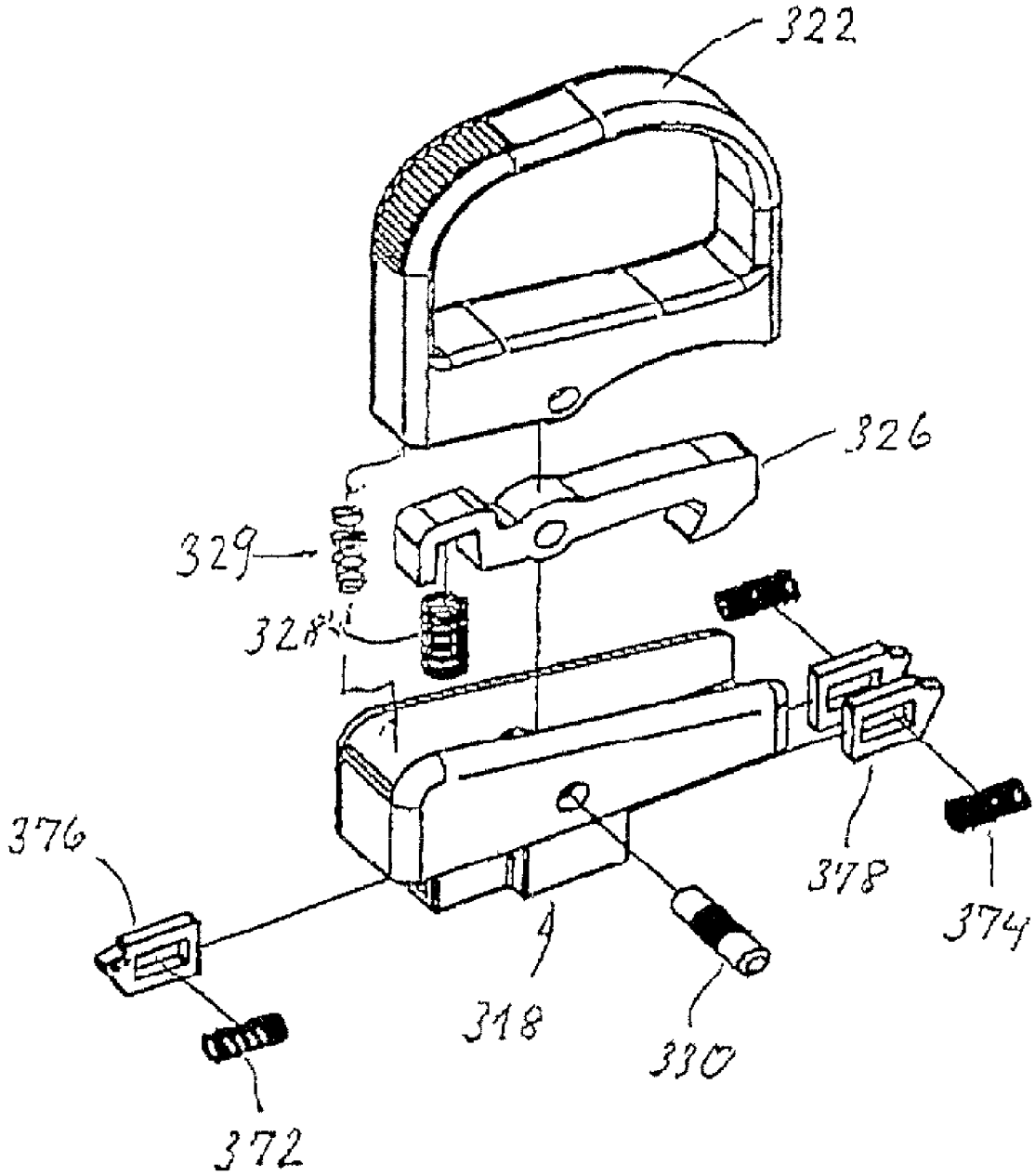
FIG. 41 shows an exploded perspective view of the closure from FIG. 35.
Figure 42E:
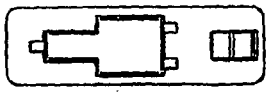
FIGS. 42A and 42B show perspective views of the assembled closure from FIG. 35 in the released position.
FIGS. 42C, D, E, F and G show the closure from FIG. 35 in the released position in a side view, a front view from the left-hand side, a bottom view, a top view, and a front view from the right-hand side referring to FIG. 42C.
Figure 42F:
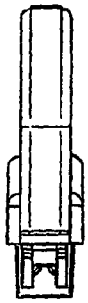
Figure 42C:
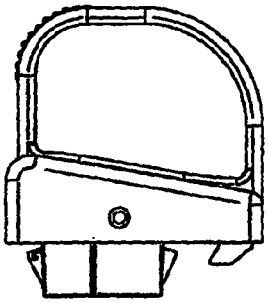
Figure 42D:
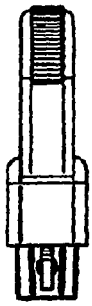
Figure 42G:
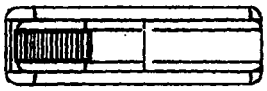
Figure 42B:
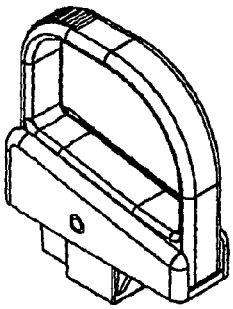
Figure 42A:
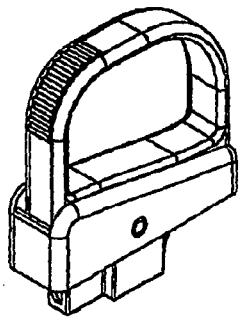
Figure 43E:
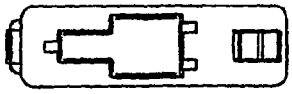
FIGS. 43A to 43G show corresponding views of the closure from FIG. 35 in the pulled in position.
Figure 43F:
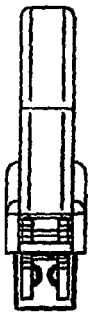
Figure 43C:
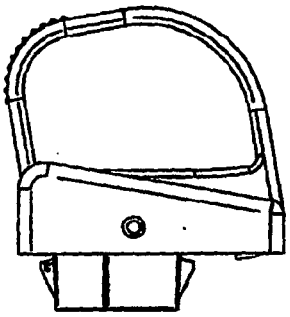
Figure 43D:
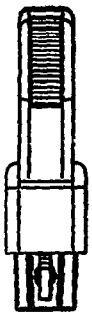
Figure 43G:
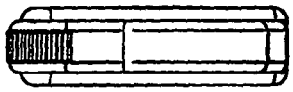
Figure 43B:
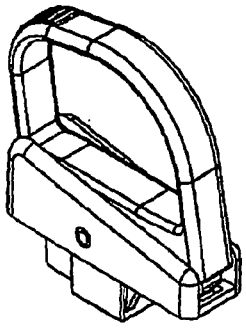
Figure 43A:
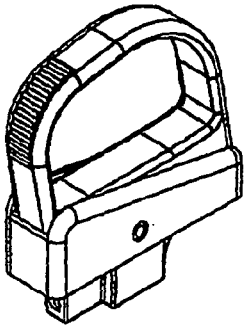

FIG. 41 shows an exploded, perspective view of the closure from FIG. 35. FIGS. 42A and 42B show perspective views of the assembled closure 310 from FIG. 35 in the released position. FIGS. 42C, D, E, F and G show the closure 310 from FIG. 35 in the released position in a side view, a front view from the left-hand side, a bottom view, a top view, and a front view from the right-hand side referring to FIG. 42C. FIGS. 43A-G show corresponding views of the closure 310 from FIG. 35 in the pulled in position.

In the last-described embodiment form, the axis is arranged close to the fastening surface of the thin wall 314, and the closure hook lever 326 extends within the longitudinal extension of the handle 322. This makes it possible to substantially prevent a translational motion of the two walls 312, 314 relative to one another with the closure 310 as is required in order to open the box 312.

In the embodiment form of the closure 210 according to FIG. 23 (or 110 according to FIG. 11), a movement of the two walls 212, 214 (or 112, 114) away from one another perpendicular to the wall plane is prevented.

While the foregoing description and drawings represent the present invention, it will be obvious to those skilled in the art that various changes may be made therein without departing from the true spirit and scope of the present invention.

REFERENCE NUMBERS

10, 110, 210, 310 snap closure
12, 112, 212, 312 sheet-metal cabinet (frame), box
14, 114, 214, 314 drawer, plug-in, cabinet housing, cabinet sheet metal, cover
16, 116, 216, 316 opening
18, 118, 218, 318 housing
20 outer side
22, 122, 222, 322 handle, actuating means
24 inner side
26, 126, 226, 326 closure hook
28, 128, 228, 328 spring force
30, 130, 230, 330 swiveling axis, pin
32 free wheel
34 coupling
36 direction
38 hook (end), tip
40, 140, 340 slot-like opening
42 side wall of the drawer
44, 144, 344 slot-like opening, slot, round hole
46 side wall of the cabinet housing
48 edge
50, 150, 250 lever projection
52 slot
54 inclined surface
56 end edge
58 line
60 stop surface
62, 262 stop surface, coupling area
64 stop surface
66, 266 stop surface
68, 268 slide bearing
70, 270 slide bearing
72, 272, 372 spring force
74, 274, 374 spring force
76, 276, 376 slide
78, 278, 378 slide
80 fastening plane
82 angle
84 fastening surface
86 inner edge of the opening
188 head screw fastening
190 projection
292, 392 snap fastening
394 hinge

What is claimed is:

1. A snap closure suitable for a thin-walled cabinet such as a sheet-metal cabinet, particularly for drawers, plug-ins, or doors, which can be pushed into or swiveled into a sheet-metal cabinet, comprising:

a housing which can be mounted in an opening of the cabinet sheet metal by a snap fastening;

an outer side of the housing having a handle which forms a closure actuating means; and a closure hook proceeding from an inner side of the housing so as to be swivelable about an axis against a first spring force so as to be rotable in a rotation plane, which closure hook is connected to the actuating means, the closure hook comprising:

a hook end adapted to engage a surface of the cabinet; and a receiving position positioned in either a) an opposed end of the closure hook, or b) in a surface opposite the closure hook end; and a spring member position on the receiving portion of the closure hook for exerting the first spring force;

wherein said actuating means, which is formed by the handle is mounted in the housing so as to be swivelable around an axis;

wherein said axis is coaxial to the of the closure hook;

wherein said closure hook is connected to the actuating means by a coupling with a free wheel;

wherein said snap fastening has two slides running in opposite directions which are mounted in the housing so as to be displaceable parallel to a fastening plane against a second spring force exerted by biasing members positioned within each slide, each slide forming a holding surface which is at an acute angle of less than 90 degrees but greater than zero degrees to the fastening plane and being supported on the inner edge of the opening in the cabinet sheet metal; and wherein the opposite directions in which the two slides run are both parallel to the rotation plane of the closure hook.

2. The snap closure according to claim 1;

wherein the handle is a U-shaped grip.

3. The snap closure according to claim 1;

wherein the closure is constructed symmetrically around a center plane and can be employed when fastening to a left-hand side of a plug-in and also to a right-hand side of a plug-in.

4. The snap closure according to claim 1;

wherein the closure is used at the top front edge of the plug-in.

5. The snap closure according to claim 1;

wherein the closure is used at the top front edge of the plug-in, in the center thereof.

6. The snap closure according to claim 1;

wherein the swiveling axis of the closure hook and the swiveling axis of the handle coaxial thereto extend parallel and close to the fastening plane for the closure housing.

7. The snap closure according to claim 1;

wherein the swiveling axis of the closure hook and the swiveling axis of the handle coaxial thereto extend parallel to and remote of the fastening plane for the closure housing.

8. The snap closure according to claim 1;

wherein the closure hook extends substantially perpendicular to the fastening plane.

9. The snap closure according to claim 1;

wherein the closure hook extends substantially parallel to the fastening plane.

10. The snap closure according to claim 1;

wherein the axis of the handle is arranged so as to be offset inside the housing in a direction in which the handle is swivelable.

11. The snap closure according to claim 1;

wherein the handle and the closure hook are compelled into their respective rest position under the spring force of a spring.

12. The snap closure according to claim 1;

wherein the handle and the closure hook are compelled into their respective rest position under the force of their own respective spring.

13. The snap closure according to claim 1;

wherein the handle has stop surfaces which abut at corresponding stop surfaces of the housing and accordingly limit the swiveling path of the handle between a locking rest position and an unlocking working position.

14. The snap closure according to claim 13;

wherein the working position of the handle is so arranged that the point of attack or the pulling force of the hand on the handle when pulling a drawer or plug-in of the sheet-metal cabinet is oriented substantially to the swiveling axis so that the handle and the housing receive only a tensile load and not a bending load.

15. Sheet-metal cabinet with plug-ins, drawers, doors, and flaps made of thin wall material such as sheet metal and whose front wall has openings for receiving the closure housing and whose side walls and adjoining cabinet housing walls have openings for receiving the closure hook of the hook closure according to claim 1.

16. The snap closure according to claim 1;

wherein the snap fastening has a third slide which runs in one of the opposite directions.

* * * * *